United States Patent [19]

Bonnamour

[11] 3,996,993

[45] Dec. 14, 1976

[54] CASTING MACHINE WITH CHANGEABLE LENGTH OF MOLD

[75] Inventor: Yves Bernard Bonnamour, Carrollton, Ga.

[73] Assignee: Southwire Company, Carrollton, Ga.

[22] Filed: July 16, 1974

[21] Appl. No.: 488,898

[52] U.S. Cl. ..... 164/87; 164/278

[51] Int. Cl.[2] ..... B22D 11/06

[58] Field of Search ..... 164/278, 87, 283 MS, 164/82

[56] References Cited

UNITED STATES PATENTS

| | | | |
|---|---|---|---|
| 3,326,271 | 6/1967 | Cofer | 164/278 |
| 3,464,483 | 9/1969 | Cofer et al. | 164/278 |
| 3,575,231 | 4/1971 | Lenaeus et al. | 164/283 MS |
| 3,628,597 | 12/1971 | Properzi | 164/278 |
| 3,735,802 | 5/1973 | Chia et al. | 164/278 |
| 3,774,669 | 11/1973 | Lenaeus et al. | 164/278 |
| 3,868,989 | 3/1975 | Properzi | 164/278 |
| 3,938,580 | 2/1976 | Donini | 164/278 |

FOREIGN PATENTS OR APPLICATIONS

| | | | |
|---|---|---|---|
| 2,271 | 1/1970 | Japan | 164/278 |
| 6,526 | 5/1970 | Japan | 164/278 |

*Primary Examiner*—Ronald J. Shore
*Assistant Examiner*—Gus T. Hampilos
*Attorney, Agent, or Firm*—Van C. Wilks; Herbert M. Hanegan; Stanley L. Tate

[57] ABSTRACT

This disclosure relates to a method of and apparatus for continuously casting molten metal in a wheel-band type continuous casting machine, wherein the machine includes a casting mold the length of which may be changed with equal facility either when the machine is shut down or during the actual casting operation. The machine includes a plurality of guide wheels disposed at predetermined angular positions with resepct to the casting wheel for guiding the casting band about the casting wheel. The mold length is varied by synchronously moving at least two of the guide wheels into angular positions different from their initial angular positions, thereby varying the position of the mold outlet and thus changing the length of the mold. At least two of the guide wheels are moved either by means for rotating the wheel through an arc about an axis parallel to the axis of rotation of the casting wheel or by means translating the guide wheel along a line of motion perpendicular to the axis of rotation of the casting wheel.

16 Claims, 6 Drawing Figures

CASTING MACHINE WITH CHANGEABLE LENGTH OF MOLD

BACKGROUND OF THE INVENTION

This invention relates generally to the metal forming art, and more particularly to a method of and apparatus for the continuous casting of molten metal in a wheel-band type continuous machine.

The continuous casting of molten metal in the peripheral groove of a rotatable casting wheel is well known in the metal foundry art. Apparatus adapted to this type of casting usually includes a rotatable casting wheel having a casting groove formed in the periphery thereof which is closed along a portion of its length by a flexible endless band forming a casting mold therewith. A cooling medium is provided about the mold for developing a cooling gradient across the molten metal so as to accomplish solidification thereof.

While the casting of relatively pure metals such as copper and aluminum entails relatively uncomplicated cooling considerations, the casting of alloys, such as copper base alloys, aluminum base alloys and various ferrous alloys, entails more closely controlled and precise cooling considerations owing to the various metallurgical effects occasioned by variations in the cooling gradient thereacross.

It should be apparent, therefore, that when using the same casting machine to cast either different metals, or different alloys of the same metal, an adjustment has to be made to the casting machine in order to correct for variations in the required cooling gradients. This adjustment depends upon the type of alloy being cast, as well as the thermal conductivity thereof.

Because there are presently such a great number and variety of alloys desired to be cast, a need has arisen in the art for a casting machine that can be easily and readily adjusted to accommodate these metals. The primary adjustment of the casting machine is in the casting speed, which is easily adjusted. Another important adjustment, but one which is not so easily accomplished, is in the cooling efficiency which, by means of prior art systems, is controlled by varying the pressure and volume of flow of the cooling fluid. Since various alloys have different thermal conductivities, the cooling efficiency of the casting machine must be readily adjustable in order to cast different blends of metals on the same casting machine.

While the prior art technique of varying the cooling efficiency by controlling the pressure and volume of cooling fluid flow is acceptable when casting pure metals such as aluminum and copper, it does not achieve a sufficiently precise control necessary for varying the coolant gradient across various alloys where the coolant rate and distribution is more critical than the coolant rate and distribution for pure metals. Accordingly, it has been found desirable to vary the cooling efficiency by changing the length of the casting mold according to the cooling gradient desired. This can be conventionally accomplished by simple varying the degree of band wrap or angle through which the flexible band covers the casting groove. Increasing the amount of band wrap increases the length of the mold, while decreasing the amount of band wrap decreases the length of the mold.

Furthermore, when casting alloys at a high rate of speed it is apparent that the cooling efficiency becomes even more critical. As explained in U.S. Pat. No. 3,623,535, issued Nov. 30, 1971, to George E. Lenaeus et al., and assigned to the assignee of this invention, in the casting of molten metal in a rotatable casting wheel, the metal cools and solidifies in three distinct phases. The first phase begins when the metal is fed into the peripheral groove of the casting wheel and includes that portion of the casting process during which the metal is being cooled but is completely liquid within the casting wheel so as to be in complete contact with the surfaces of the casting mold. The second phase is that portion of the casting process during which the continued cooling of the metal causes an outer crust of solidified metal to form adjacent the surfaces of the casting mold, but during which the metal is still in substantially complete contact therewith. The third phase is that portion of the casting process beginning generally at or near that point in the solidification of the metal at which the continued cooling of the metal and thickening of the outer crust of solidilfied metal causes the metal to shrink away from the casting wheel and is that portion during which an air gap forms between the metal and the casting wheel.

The third solidification phase is the most troublesome inasmuch as the air gap between the metal and the casting surfaces greatly reduces the rate of heat transfer from the metal. In order to overcome this problem, it is disclosed in the aforementioned U.S. Pat. No. 3,623,535 to remove the flexible band from the casting wheel to expose the metal for direct cooling during some or all of the third solidification phase, thereby allowing the rotational speed and thus the casting rate of the casting wheel to be greatly increased since the effect of the air gap between the metal and the casting wheel is eliminated and the metal is exposed for direct cooling.

In view of the foregoing, it should be apparent that it is advantageous to provide a casting machine wherein the length of the casting mold is variable, not only to accommodate the casting of various metals and metal alloys, but also to permit the casting of alloys at a high rate of speed by means of the technique disclosed in the aforementioned U.S. Pat. No. 3,623,535, i.e., by shortening the angle of band wrap such that the peripheral groove in the casting wheel is covered only during the first and second phase of metal solidification. While the prior art has developed wheel-band casting machines wherein the casting band may be removed during shutdown of the machine and a shorter or longer band reinserted, with concomitant changes in the positions of the guide wheels, so as to change the length of the casting mold, there remains a need in the art for a casting machine wherein the length of the casting mold may be changed without replacing the casting band, and wherein this operation can be accomplished during the actual casting operation, as well as when the machine is shut down.

Additionally, when a continuous casting operation is first started, the casting rate (i.e., the rotational speed of the casting wheel) is maintained at a relatively low level concomitant with the other system parameters (e.g., temperature of the metal and the wheel, coolant pressure and volume, pouring rate, etc.). However, after the start-up period and when the casting machine is continuously operating at an equilibrium condition, the casting rate is then increased. Consequently, the cooling rate must also be increased to maintain the cooling gradient at the increased casting rate. This is, of course, conventionally accomplished by increasing the pressure and volume of coolant flow. Although it would be advantageous to increase the cooling rate by removing some of the band wrap to thereby subject the cast bar to direct spray cooling, this cannot be accomplished with prior art machines which have no means for changing the length of the mold (i.e., the degree of arc that the band covers the peripheral groove) during operation of the casting machine.

SUMMARY OF THE INVENTION

In view of the foregoing, it should be apparent that there is still a need in the art of a wheel-band type continuous casting machine wherein the length of the casting mold may be readily changed without replacing the casting band, and particularly during the actual casting operation so as to maximize cooling efficiency. It is, therefore, a primary object of this invention to provide a wheel-band type continuous casting machine which is adapted to cast different metals as well as different alloys of the same metal.

More particularly, it is an object of this invention to provide a casting machine having a casting mold defined between the peripheral groove of a rotatable casting wheel closed over a portion of its length by an endless band, and means for varying the mold outlet point with respect to the casting wheel during the casting operation, thereby changing the length of the casting mold.

Still more particularly, it is an object of this invention to provide a casting machine which includes a plurality of guide wheels disposed at predetermined angular positions with respect to the casting wheel for guiding the endless band about the casting wheel, and wherein the means for varying the angular position of the mold outlet include means for synchronously moving at least two of the guide wheels into angular positions different from the predetermined angular positions.

Another object of this invention is to provide a wheel-band type continuous casting machine having means for varying the cooling efficiency by changing the length of the casting mold according to the cooling gradient desired.

A further object of this invention is to provide a method of casting molten in a wheel-band type continuous casting machine wherein the casting operation is started by initially rotating the casting wheel at a given rate of rotation, and, after an equilibrium casting condition is established, increasing the casting rate and concomitantly increasing the cooling efficiency by decreasing the length of the casting mold and applying the cooling medium directly against the exposed metal.

Briefly described, these and other objects of the invention are accomplished in accordance with this invention first, in its apparatus aspects, by providing a casting machine comprising a rotatable casting wheel having a casting groove formed in the periphery thereof which is closed along a portion of its length by an endless band forming a casting mold therewith. The band initially engages the periphery of the wheel at a first point defining a mold inlet and disengages the wheel at a second point defining a mold outlet. The casting machine further includes a plurality of guide wheels disposed at predetermined angular positions with respect to the casting wheel for guiding the endless band thereabout. The guide wheels include a presser wheel for guiding the band into initial engagement with the casting wheel to define the mold inlet, a counter wheel for guiding the band away from the casting wheel to define the mold outlet, and a tension wheel for guiding the band between the counter wheel and the pressure wheel to maintain tension in the band.

In order to vary the length of the casting mold, means are provided for synchronously moving the counter wheel and the tension wheel into angular positions different from the initial predetermined angular positions thereof. In a first embodiment of the invention, the means for synchronously moving the counter wheel and the tension wheel include means for rotating the counter wheel through an arc about an axis coincident with the axis of rotation of the casting wheel, and means for translating the tension wheel along a line of motion perpendicular to the axis of rotation of the casting wheel. In a second embodiment of the invention, the means for synchronously moving the counter wheel and the tension wheel include means for rotating the counter wheel through an arc about an axis coincident with the axis of rotation of the casting wheel, and means for rotating the tension wheel through an arc about an axis parallel to the axis of rotation of the casting wheel. In a third embodiment of the invention, the means for sychronously moving the counter wheel and the tension wheel include means for translating both the wheels along lines of motion perpendicular to the axis of rotation of the casting wheel.

In the method aspect of the invention, a method of changing the length of the casting mold of a wheel-band type continuous casting machine during the casting operation is accomplished by synchronously maintaining the band tension while varying the position of the mold outlet to either increase or decrease the amount of band covering the casting groove, thereby continuously maintaining the band in contact with the casting wheel as the length of the mold is changed, thus facilitating the change during a casting operation.

Additionally, the method of casting molten metal in a wheel-band type continuous casting machine in accordance with this invention includes the steps of:

a. starting the casting operation by initially rotating the casting wheel at a given rate of rotation;

b. pouring molten metal into the inlet of the casting mold at a given rate consonant with the rate of rotation of the casting wheel;

c. providing a cooling medium against the external mold surfaces to obtain a cooling gradient across the molten metal in the casting mold to at least partially solidify the molten metal therein;

d. establishing an equilibrium casting condition by controlling the pouring of the molten metal and the providing of the cooling medium;

e. thereafter increasing the casting rate by increasing the rate of rotation of the casting wheel; and f. increasing the efficiency of the cooling medium to maintain the cooling gradient at the increasing casting rate by decreasing the length of band covering the casting groove and applying the cooling medium directly against the at least partially solidified metal therein exposed by the removal of the band therefrom.

With the above and other objects in view that may become hereinafter apparent, the nature of the invention may be more clearly understood by reference to the several views illustrated in the attached drawings, the following detailed description thereof, and the appended claimed subject matter:

IN THE DRAWINGS

FIG. 1 is a schematic elevation view of a wheel-band type continuous casting machine constructed in accordance with this invention, and illustrates in solid lines three guide wheels over which the flexible band is guided about the casting wheel to define an initial mold of a given length, and further illustrates in phantom two of the guide wheels being moved into alternate positions with the flexible band guided thereabout to define a casting mold of a second shorter length, and means for rotating one of the guide wheels into its alternate position and means for translating the other guide wheel into its alternate position;

Figure 1:
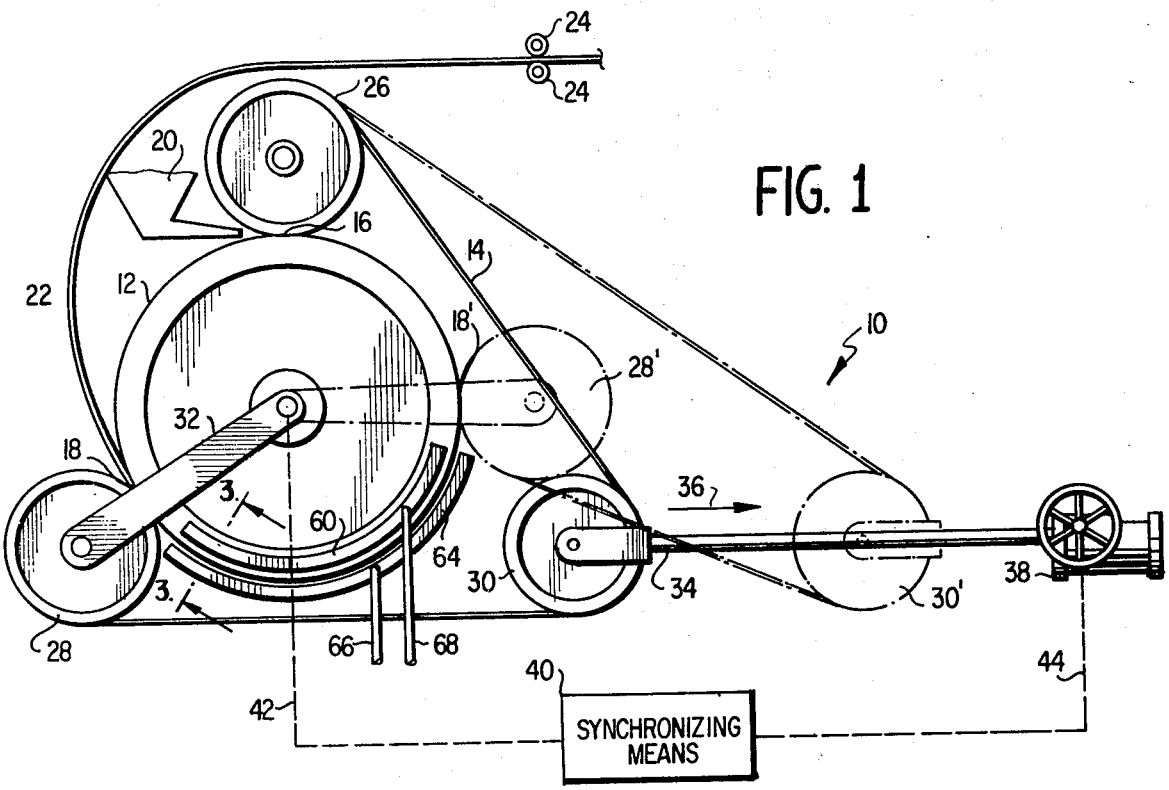
Figure 6:
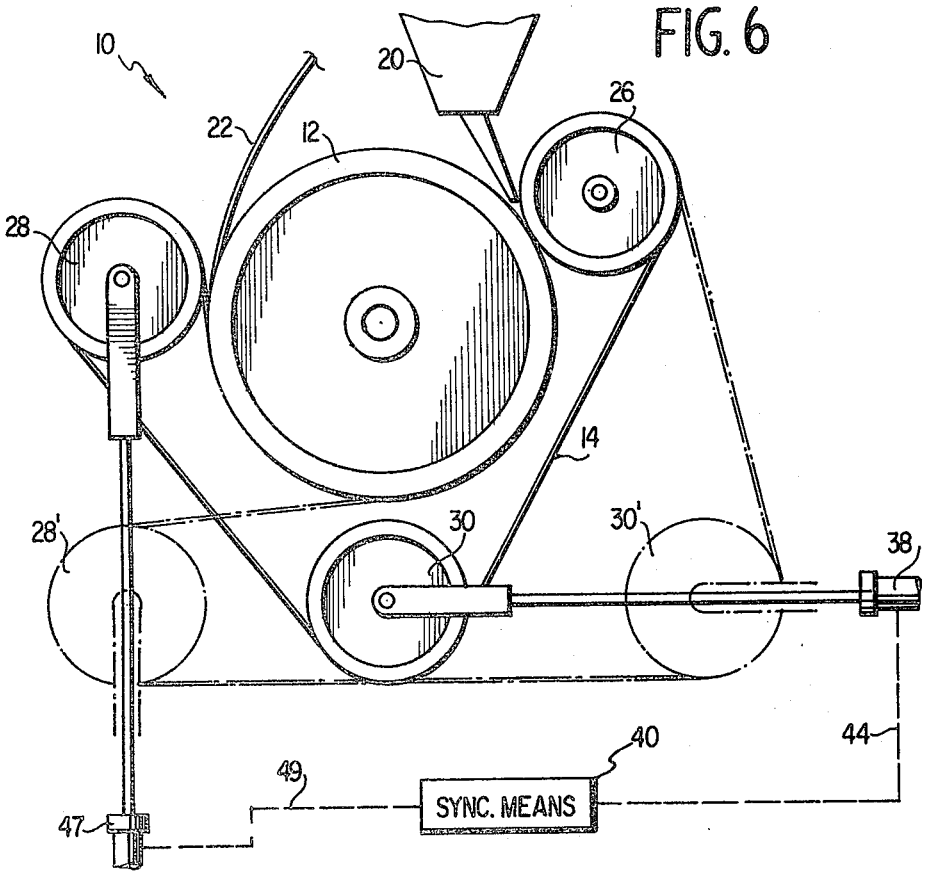
Figure 5:
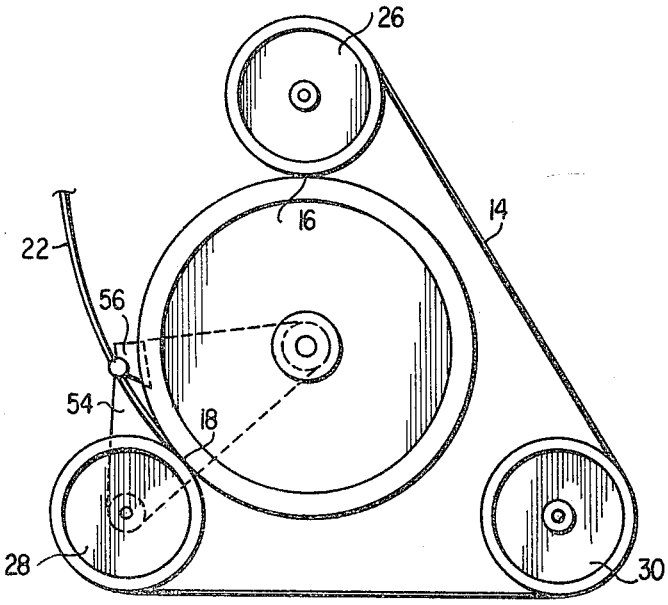

FIG. 5 is a schematic elevation view of another modification of the casting machine illustrated in FIG. 1, and also illustrates one of the guide wheels being moveable by means of an enlarged pivot arm, the pivot arm carrying a stripper shoe for guiding the cast bar out of the mold outlet; and FIG. 6 is a schematic elevation view of another alternate embodiment of the casting machine illustrated in FIG. 1, and illustrates means for translating both of the movable guide wheels into their alternate positions.

DETAILED DESCRIPTION OF PREFERRED EMBODIMENTS

Referring now to the drawings in detail, there is illustrated in FIG. 1 a wheel-band type continuous casting machine designated generally by the numeral 10. The casting machine 10 includes a rotatable casting wheel 12 having a casting groove formed in the periphery thereof which is closed along a portion of its length by a flexible endless band 14 to define a casting mold therewith. The band 14 initially engages the periphery of the wheel 12 at a first point 16 defining the mold inlet and disengages the periphery of the wheel 12 at a second point 18 defining the mold outlet. Molten metal is poured from a pour pot or tundish 20 into the inlet 16 of the casting mold and is solidified therein and exits from the mold outlet 18 as a cast bar 22. The cast bar 22 is supported by suitable means (not shown) and withdrawn from the casting machine 10 by pinch rolls 24. The cast bar 22 may then be either coiled and stored, or delivered immediately in the as-cast condition to suitable hot-forming means such as a rolling mill having a plurality of roll stands positioned therein wherein the bar 22 is reduced in cross-section in a number of deformations into rod.

In order to guide the endless band 14 about the casting wheel 12, a plurality of guide wheels are provided. Although the casting machine 10 is illustrated as including three such guide wheels, any number of guide wheels may be utilized, four or more such wheels being equally conventional. As illustrated, the casting machine 10 includes a presser wheel 26 by means of which the band 14 is guided into initial engagement with the casting wheel 12. The presser wheel 26 may be pivoted either toward or away from the casting wheel 12 so as to slightly change the position that the band comes into initial engagement with the wheel 12 and thus vary the mold inlet point 16. This is a conventional adjustment and is not intended to be a part of the invention disclosed herein. The casting machine 10 also includes a counter wheel 28 which guides the flexible band 14 away from the periphery of the casting wheel 12 to define the mold outlet point 18. Conventionally, such counter wheels 28 are fixedly mounted with respect to the casting wheel 12 and the angular position thereof cannot be readily changed without shutting down the casting machine. A tension wheel 30 is also provided over which the flexible band 14 travels in its return path from the counter wheel 28 to the presser wheel 26 and by means of which the tension in the band 14 is maintained. Conventionally, such tension wheels are normally adjustable along a radial line of the casting wheel in order to vary the tension in the band.

In accordance with this invention, the length of the casting mold defined by the degree of arc extending between the mold inlet point 16 and the mold outlet point 18 can be changed, such change being possible during the actual casting operation or when the casting machine 10 is shut down. To this end, the counter wheel 28 is mounted on a pivot arm 32 the axis of rotation of which is coincident with the axis of rotation of the casting wheel 12. Means (not shown) located behind the casting wheel 12 are provided for rotating the pivot arm 32, and thus the counter wheel 28, into an infinite number of angular positions with respect to the casting wheel 12, one such position of the counter wheel being illustrated 28'. In this position, the length of the mold extends for approximately 90° from the mold inlet point 16 to a new mold has been reduced by an amount greater than 50 percent and the mold outlet point 18'.

In order to accommodate for variations in tension in the band 14 when the mold length is changed owing to movement of the counter wheel 28, the tension wheel 30 is mounted on a screw shaft 34 by means of which the tension wheel 30 may be translated horizontally in the direction of the arrow 36. When the counter wheel 28 is in the position 28', the tension wheel 30 will be in the position 30'. The screw shaft 34 may be caused to translate by drive means 38, such as a hand wheel acting through a suitable gearing arrangement, or by powered means such as a motor, hydraulic cylinder, or the like.

In order to change the mold length during a casting operation, the tension in the band 14 must be maintained constant so that at least a portion of the band will always be maintained in contact with the periphery of the casting wheel 12. Accordingly, suitable synchronizing means 40 are provided for assuring simultaneous movement of both the counter wheel 28 and the tension wheel 30. As illustrated schematically in FIG. 1, both the means for rotating the pivot arm 32 and for translating screw shaft 34 are connected to the synchronizing means 40, as illustrated diagrammatically by the dashed lines 42, 44, respectively. The synchronizing means 40 may be a suitable electrical control circuit for automatically actuating and controlling movement of either the pivot arm 32 or the screw shaft 34 in response to movement of the other, or simply a mechanical linkage which provides for simultaneous movement of both the counter wheel 28 and the tension wheel 30 in such a manner that tension in the band 14 will be maintained constant.

Figure 2:
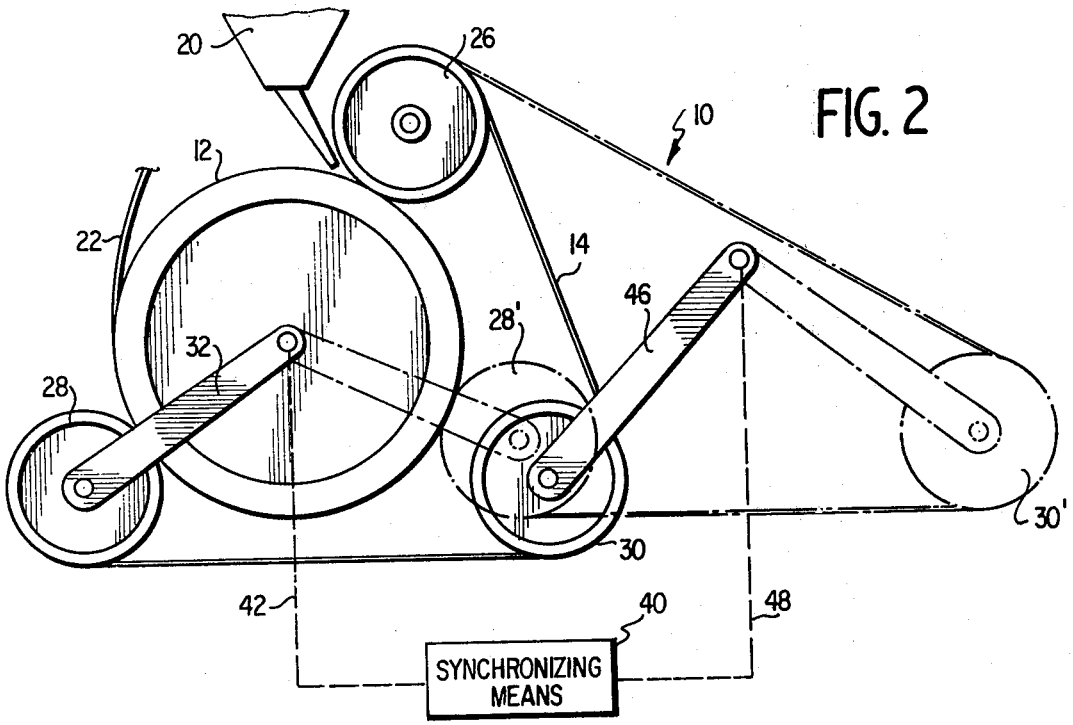
FIG. 2 is a schematic elevation view of an alternate embodiment of the casting machine illustrated in FIG. 1, and illustrates means for rotating both of the movable guide wheels into their alternate positions.

Referring now to FIG. 2, there is illustrated an alternate embodiment of the casting machine 10. This embodiment is substantially identical to the embodiment of FIG. 1, except that the tension wheel 30 is moved through a circular adjustment by means of a pivot arm 46 which is similar to the pivot arm 32 used to move the counter wheel 28. The pivot arm 46 is moved by means (not shown) about an axis extending substantially parallel to the axis of rotation of the casting wheel 12. The means (not shown) for moving the pivot arm 46 are connected by suitable means to the synchronizing means 40, as illustrated diagrammatically by the dashed line 48.

Referring to FIG. 6, there is illustrated another alternate embodiment of the casting machine 10. This embodiment is substantially identical to the embodiment of FIG. 1, except that the counter wheel 28 is moved through a linear adjustment by means of a suitable translation device 47. The translation device 47 is suitable connected to the synchronizing means 40, as illustrated diagrammatically by the dashed line 49.

Figure 4:
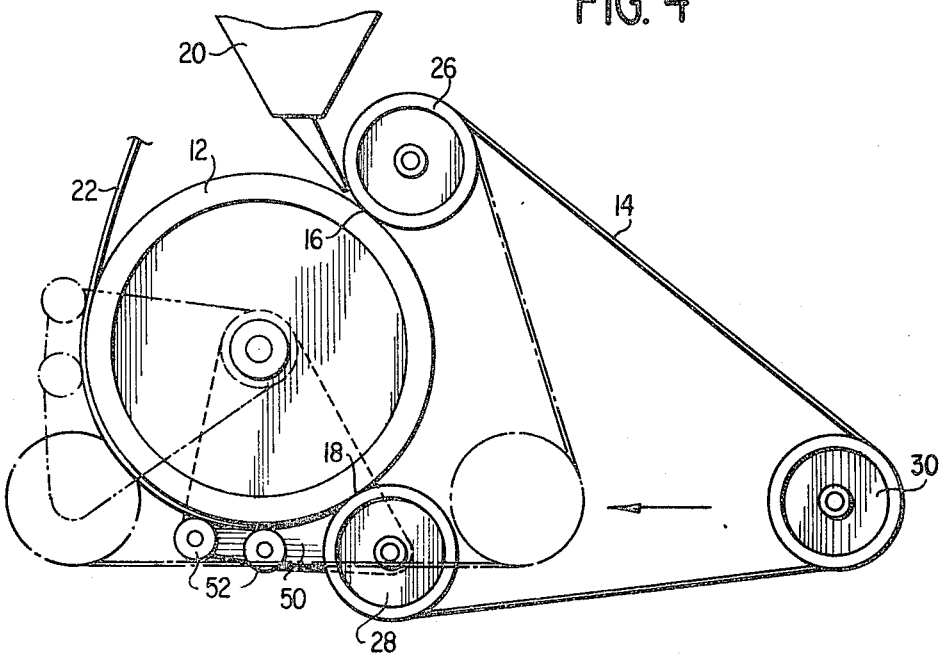
FIG. 4 is a schematic elevation view of a modification of the casting machine illustrated in FIG. 1, and illustrates an enlarged pivot arm for rotating one of the guide wheels about the periphery of the casting wheel, the pivot arm carrying roller means for supporting the cast bar after it exits the mold outlet.

A modification of the casting machine 10 of FIG. 1 is illustrated in FIG. 4. In this modification the counter wheel 28 is mounted on an enlarged, substantially triangular-shaped pivot arm 50 on which are rotatably mounted roller means 52 which function to support and press the cast bar 22 in the casting groove of the casting wheel 12 after it exits from the mold outlet point 18. It should be apparent, therefore, that as the pivot arm 50 is rotated to change the angular position of the counter wheel 28 and thus the position of the mold outlet point 18, the angular position of the roller means 52 with respect to the mold outlet 18 will be maintained constant.

Referring now to FIG. 5, there is illustrated yet another modification of the casting machine 10 of FIG. 1. In this modification the counter wheel 28 is rotatably mounted on an enlarged, triangular-shaped pivot arm 54 similar to the pivot arm 50 illustrated in the modification of FIG. 4. The pivot arm 54 carries a stripper shoe 56 for guiding the cast bar 22 out of the mold outlet point 18. It should be apparent, therefore, that the angular position of the stripper shoe 56 will be maintained constant with respect to the mold outlet point 18 as the pivot arm 54 is rotated to change the position of the counter wheel 28 and thus the position of the mold outlet point 18.

Figure 3:
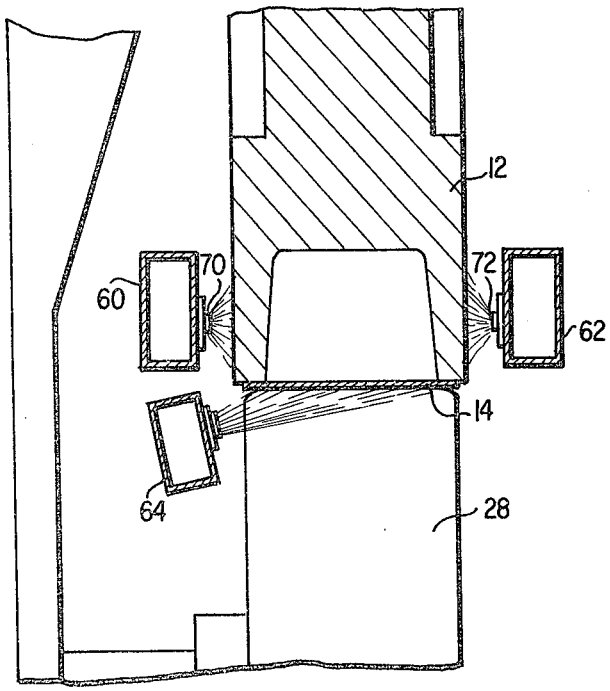
FIG. 3 is an enlarged fragmentary sectional view taken along line 3—3 of FIG. 1, and illustrates two side spray headers disposed on opposite sides of the casting mold, as well as a band spray header also disposed on one side of the casting mold, thereby providing an unobstructed path of travel of one of the guide wheels about the perimeter of the casting wheel.

Referring now to FIGS. 1 and 3, it can be seen that the casting machine 10 includes means for spraying a cooling fluid against the external surfaces of the casting mold comprising arcuate side spray headers 60, 62 disposed on opposite sides of the periphery of the casting wheel 12, and an arcuate band spray header 64 also disposed on one side of the casting wheel 12. Suitable conduit means 66, 68 are provided for delivering a cooling fluid to the respective spray headers. The side spray headers 60, 62 include spray nozzle means 70, 72 for directing a cooling fluid spray against the sides of the casting mold, while the band spray header 64 includes suitable nozzle means 74 for directing a cooling fluid spray against the flexible band 14.

While in prior art cooling devices of this type, the band spray means is adapted to emit a spray substantially perpendicular to the band, it can be seen in FIG. 3 that in accordance with this invention the spray nozzle means 74 of the band spray header 64 emits a spray at an acute angle to the band 14 from its position to one side of the casting wheel 12. Owing to this arrangement, the area about the periphery of the casting wheel 12 in the cooling zone is left unobstructed so that the counter wheel 28 can be moved around the periphery of the casting wheel 12 so as to change the length of the casting mold without being impeded by any of the cooling spray headers.

It should be apparent, therefore, that with the casting machine 10 illustrated in FIG. 1, when the counter wheel 28 is in the eight o'clock position the band spray header 64 will function to spray a portion of the band 14, and when the counter wheel is moved to the three o'clock position at 28' the spray header 64 will function to apply a cooling fluid spray directly against the metal in the casting groove which has been exposed by removal of the band 14 therefrom.

In view of the foregoing, it should be apparent that there is provided in accordance with this invention novel means for changing the length of a casting mold in a wheel-band type continuous casting machine which permits the mold length to be changed either when the machine is shut down or during an actual casting operation. Additionally, the novel method of changing the mold length during the casting operation permits maximizing the cooling efficiency of the casting machine as the rate of casting is increased after the initial start-up of the casting machine.

Although only preferred embodiments of the invention have been specifically illustrated and described herein, it is to be understood that minor modifications could be made therein without departing from the scope of the invention.

It is claimed:

1. In a wheel-band type continuous casting machine for casting molten metal into a continuous bar comprising a rotatable casting wheel having a casting groove formed in the periphery thereof which is closed along a portion of its length by an endless band forming a casting mold therewith, said band having inner and outer surfaces and being guided about said casting wheel by a plurality of guide wheels with said inner surface engaging said guide wheels and said outer surface engaging said casting wheel, said band initially engaging the periphery of said casting wheel at a first point defining a mold inlet and disengaging said casting wheel at a second point defining a mold outlet;

the improvement comprising means for synchronously moving at least two of said guide wheels for varying the angular position of said second point with respect to said casting wheel during the casting operation to substantially change the length of band covering said casting groove.

2. The combination of claim 1 wherein said plurality of guide wheels are disposed at predetermined angular positions with respect to said casting wheel for guiding said endless band about said casting wheel, and wherein said synchronous moving means includes means for moving at least two of said guide wheels into angular positions different from said predetermined angular positions.

3. The combination of claim 2 wherein said guide wheels include a presser wheel for guiding said band into initial engagement with said casting wheel to define said mold inlet, a counter wheel for guiding said band away from said casting wheel to define said mold outlet and a tension wheel for guiding said band between said counter wheel and said presser wheel to maintain tension in said band, and wherein said means for synchronously moving include means for moving said counter wheel and said tension wheel.

4. The combination of claim 3 wherein said means for moving include means for rotating said counter wheel through an arc about an axis coincident with the axis of rotation of said casting wheel, and means for translating said tension wheel along a line of motion perpendicular to the axis of rotation of said casting wheel.

5. The combination of claim 3 wherein said means for moving include means for rotating said counter wheel through an arc about an axis coincident with the axis of rotation of said casting wheel, and means for rotating said tension wheel through an arc about an axis parallel to the axis of rotation of said casting wheel.

6. The combination of claim 3 wherein said means for moving include means for translating both said counter wheel and said tension wheel along lines of motion perpendicular to the axis of rotation of said casting wheel,

7. The combination of claim 3 wherein said means for moving include pivot arm means for rotating said counter wheel through an arc about an axis coincident with the axis of rotation of said casting wheel.

8. The combination of claim 7, and further including stripper shoe means for guiding the cast bar out of said mold outlet, said stripper shoe means being mounted on said pivot arm means whereby the angular position of said stripper shoe means with respect to said mold outlet will be maintained constant as said pivot arm means is rotated to vary the position of said mold outlet.

9. The combination of claim 7, and further including roller means for supporting the cast bar after it exits said mold outlet, said roller means being mounted on said pivot arm means whereby the angular position of said roller means with respect to said mold outlet will be maintained constant as said pivot arm means is rotated to vary the position of said mold outlet.

10. The combination of claim 2, said casting machine further including cooling means including arcuate side spray headers disposed about a portion of the periphery of said casting wheel for emitting a cooling fluid spray against the outer sides of said casting groove and an arcuate band spray header disposed about a portion of the periphery of said casting wheel for emitting a cooling fluid spray against said band, and wherein said band spray header as well as said side spray headers are mounted to the sides of said casting wheel thereby facilitating unobstructed movement of at least one of said at least two guide wheels about said casting wheel during changing of the length of said mold.

11. In a wheel-band type continuous casting machine for casting molten metal into a continuous bar comprising a rotatable casting wheel having a casting groove formed in the periphery thereof which is closed along a portion of its length by an endless band forming a casting mold therewith, said band having inner and outer surfaces and being guided about said casting wheel by a plurality of guide wheels with said inner surface engaging said guide wheels and said outer surface engaging said casting wheel, said band initially engaging the periphery of said casting wheel at a first point defining a mold inlet and disengaging said casting wheel at a second point defining a mold outlet, the improvement comprising means for synchronously moving at least two of said guide wheels to vary the angular position of said second point with respect to said casting wheel and reduce the length of the casting mold to any one of a number of different mold lengths using the same endless band.

12. In a wheel-band type continuous casting machine for casting molten metal into a continuous bar comprising a rotatable casting wheel having a casting groove formed in the periphery thereof which is closed along a portion of its length by an endless band forming a casting mold of a given length therewith, said band initially engaging the periphery of said wheel at a first point defining a mold inlet and disengaging said wheel at a second point defining a mold outlet; the improvement comprising means for rotating the casting wheel at a first rate of rotation, means positioned adjacent the mold inlet for pouring molten metal into said inlet at a rate consonant with the first rate of rotation of the casting wheel, means associated with the casting machine for applying a cooling medium against the mold surfaces to obtain a cooling gradient across the molten metal in the casting mold to at least partially solidify the molten therein, means operatively associated with said pouring means and applying means for controlling the pouring means and the cooling medium applying means to establish an equilibrium casting condition, means operatively associated with said rotating means for increasing the rotation rate of the casting wheel to a second rate of rotation after establishment of said equilibrium casting condition, means associated with said endless band for decreasing the length of the band covering the casting groove during the casting operation and after establishment of said equilibrium casting condition, and means associated with said casting machine for applying a cooling medium directly against the at least partly solidified metal in the casting groove exposed by the decreasing of the length of the band covering the casting groove to thereby maintain said cooling gradient at the increased casting rate.

13. A method of changing the length of the casting mold of a wheel-band type continuous casting machine during the casting operation, the casting machine including a rotatable casting wheel having a casting groove formed in the periphery thereof which is closed along a portion of its length by an endless band under a given tension thereby forming a casting mold having an inlet and an outlet; the method comprising:

varying the position of the mold outlet to either increase or decrease by at least fifty percent the amount of band covering the casting groove, and synchronously maintaining the band tension during the step of varying whereby a portion of the band is continuously maintained in contact with said casting wheel as the length of the mold is changed, thereby facilitating said change during the casting operation.

14. A method of casting molten metal in a wheel-band type continuous casting machine, the casting machine including a rotatable casting wheel having a casting groove formed in the periphery thereof which is closed along a portion of its length by an endless band under a given tension thereby forming a casting mold of given length having an inlet and an outlet, the method comprising:

a. starting the casting operation by initially rotating the casting wheel at a given rate of rotation;
b. pouring molten metal into the inlet of the casting mold at a given rate consonant with the rate of rotation of the casting wheel;
c. providing a cooling medium against the external mold surfaces to obtain a cooling gradient across the molten metal in the casting mold to at least partially solidify the molten metal therein;
d. establishing an equilibrium casting condition by controlling the pouring of the molten metal and the providing of the cooling medium;
e. thereafter increasing the casting rate by increasing the rate of rotation of the casting wheel; and
f. increasing the efficiency of the cooling medium to maintain the cooling gradient at the increased casting rate by decreasing the length of band covering the casting groove and applying the cooling medium directly against the at least partially solidified metal therein exposed by the removal of the band therefrom.

15. A method of casting molten metal as defined in claim 14 wherein the step of decreasing the length of band covering the casting groove is accomplished by moving the position of the mold outlet closer to the position of the mold inlet.

16. A method of casting molten metal as defined in claim 15, and further including synchronously maintaining the same band tension during the step of moving the position of the mold outlet whereby a portion of the band is continuously maintained in contact with the casting groove as the length of the mold is reduced, thereby facilitating said reduction in mold length during the casting operation.

* * * * *